US011236427B2

(12) United States Patent
Buchanan

(10) Patent No.: US 11,236,427 B2
(45) Date of Patent: Feb. 1, 2022

(54) SYSTEMS AND METHODS FOR IN-LINE THERMAL FLATTENING AND ENAMELING OF STEEL SHEETS

(71) Applicant: PolyVision Corporation, Johns Creek, GA (US)

(72) Inventor: Kevin Peter Buchanan, Norcross, GA (US)

(73) Assignee: POLYVISION CORPORATION, Johns Creek, GA (US)

( * ) Notice: Subject to any disclaimer, the term of this patent is extended or adjusted under 35 U.S.C. 154(b) by 215 days.

(21) Appl. No.: 16/164,362

(22) Filed: Oct. 18, 2018

(65) Prior Publication Data

US 2019/0169756 A1 Jun. 6, 2019

Related U.S. Application Data

(60) Provisional application No. 62/595,295, filed on Dec. 6, 2017.

(51) Int. Cl.
*C23D 5/00* (2006.01)
*C23D 5/02* (2006.01)
(Continued)

(52) U.S. Cl.
CPC ..... *C23D 5/005* (2013.01); *C23D 5/00* (2013.01); *C23D 5/02* (2013.01); *B05D 3/0218* (2013.01);
(Continued)

(58) Field of Classification Search
CPC . C23D 5/00; C23D 5/005; C23D 5/02; C23D 5/04; C23D 5/06; C23D 5/08; C23D 5/10; C23D 9/00; C23D 11/00; B05D 3/0218; B05D 3/0227; B05D 3/0413; B05D 3/12; B05D 2202/10; B05D 2202/15;
(Continued)

(56) References Cited

U.S. PATENT DOCUMENTS 2,414,633 A 1/1947 Bryant
2,487,137 A 11/1949 Hoover et al.
(Continued)

FOREIGN PATENT DOCUMENTS

EP 0480404 B1 7/1995
EP 2145971 A1 * 1/2010 ..... C22C 38/16
(Continued)

OTHER PUBLICATIONS

JFE Steel Corporation, "Cold Rolled Steel Sheet" (Year: 2006).*

*Primary Examiner* — Anthony J Zimmer
*Assistant Examiner* — Dean Mazzola
(74) *Attorney, Agent, or Firm* — Troutman Pepper Hamilton Sanders LLP; Ryan A. Schneider

(57) ABSTRACT

The present disclosure provides systems and methods for in-line thermal flattening and enameling of steel sheets. The systems and methods include an in-line thermal flattening of a feed stock steel sheet and a subsequent enamel coating of the steel sheet. The resulting enamel coated steel sheet has improved flatness compared with other coated steel sheets that are enamel coated but do not undergo the in-line thermal flattening. The systems and methods allow the use of less expensive source materials without sacrificing quality in the finished enameled product.

45 Claims, 5 Drawing Sheets

(51) Int. Cl.

| | |
|---|---|
| ***C21D 9/46*** | (2006.01) |
| ***C21D 8/02*** | (2006.01) |
| ***C23D 9/00*** | (2006.01) |
| ***C21D 9/56*** | (2006.01) |
| ***C23D 11/00*** | (2006.01) |
| *B05D 3/02* | (2006.01) |

(52) U.S. Cl.
CPC ..... *B05D 2202/10* (2013.01); *B05D 2252/02* (2013.01); *B05D 2252/10* (2013.01); *C21D 8/0205* (2013.01); *C21D 8/0226* (2013.01); *C21D 8/0236* (2013.01); *C21D 9/46* (2013.01); *C21D 9/564* (2013.01); *C23D 9/00* (2013.01); *C23D 11/00* (2013.01)

(58) Field of Classification Search
CPC ..... B05D 2252/00; B05D 2252/02; B05D 2252/04; B05D 2252/10; C21D 8/0205; C21D 8/0236; C21D 8/0242; C21D 9/46
See application file for complete search history.

(56) References Cited

U.S. PATENT DOCUMENTS

| | | | | |
|---|---|---|---|---|
| 2,580,406 | A * | 1/1952 | Calton | C23D 5/02 118/65 |
| 2,602,758 | A | 7/1952 | Olt et al. | |
| 2,755,210 | A | 7/1956 | Sutphen et al. | |
| 2,878,151 | A | 3/1959 | Beall et al. | |
| 3,265,541 | A | 8/1966 | Elias | |
| 3,582,409 | A | 6/1971 | Kohler | |
| 3,615,278 | A | 10/1971 | Yamamoto et al. | |
| 3,626,578 | A | 12/1971 | Price et al. | |
| 3,849,214 | A | 11/1974 | Foster | |
| 3,856,568 | A | 12/1974 | Tanaka et al. | |
| 3,912,549 | A | 10/1975 | Gondo et al. | |
| 3,928,083 | A | 12/1975 | Gondo et al. | |
| 3,950,191 | A | 4/1976 | Ito et al. | |
| 4,348,229 | A | 9/1982 | Suemura et al. | |
| 4,494,929 | A | 1/1985 | Fujioka et al. | |
| 4,592,958 | A | 6/1986 | Mosser et al. | |
| 4,596,613 | A * | 6/1986 | Lin | H01F 1/15341 148/122 |
| 4,670,065 | A | 6/1987 | Yasuda et al. | |
| 4,782,994 | A | 11/1988 | Raybould et al. | |
| 4,923,396 | A | 5/1990 | Harada et al. | |
| 4,985,635 | A | 1/1991 | Inokuti et al. | |
| 5,096,510 | A | 3/1992 | Schoen et al. | |
| 5,098,491 | A | 3/1992 | Osawa et al. | |
| 5,137,584 | A * | 8/1992 | Jesseman | C21D 8/0268 148/328 |
| 5,152,846 | A | 10/1992 | Osawa et al. | |
| 5,292,383 | A | 3/1994 | Osawa et al. | |
| 5,405,463 | A | 4/1995 | Shimomura et al. | |
| 5,427,843 | A | 6/1995 | Miyajima et al. | |
| 5,679,469 | A | 10/1997 | Shimoda et al. | |
| 5,753,051 | A | 5/1998 | Kanai et al. | |
| 5,799,527 | A | 9/1998 | Kenmochi et al. | |
| 5,993,974 | A | 11/1999 | Fukushima et al. | |
| 6,190,164 | B1 | 2/2001 | Ueno et al. | |
| 6,287,703 | B1 | 9/2001 | Inokuti | |
| 6,544,355 | B1 | 4/2003 | Nishimura et al. | |
| 6,562,473 | B1 | 5/2003 | Okabe et al. | |
| 6,716,490 | B2 | 4/2004 | Hayashi et al. | |
| 6,808,678 | B2 | 10/2004 | Murakami et al. | |
| 7,727,644 | B2 | 6/2010 | Watanabe et al. | |
| 7,854,808 | B2 | 12/2010 | Murakami et al. | |
| 7,922,837 | B2 | 4/2011 | Murakami et al. | |
| 8,097,205 | B2 | 1/2012 | Sugano et al. | |
| 8,236,111 | B2 | 8/2012 | Murakami et al. | |
| 8,491,735 | B2 | 7/2013 | Murakami et al. | |
| 8,784,995 | B2 | 7/2014 | Omura et al. | |
| 9,067,260 | B2 | 6/2015 | Bonnet et al. | |
| 9,073,114 | B2 | 7/2015 | Murakami et al. | |
| 9,290,824 | B2 | 3/2016 | Watanabe et al. | |
| 9,330,839 | B2 | 5/2016 | Omura et al. | |
| 9,396,872 | B2 | 7/2016 | Inoue et al. | |
| 9,406,437 | B2 | 8/2016 | Omura et al. | |
| 9,514,868 | B2 | 12/2016 | Omura et al. | |
| 9,536,657 | B2 | 1/2017 | Omura et al. | |
| 9,536,658 | B2 | 1/2017 | Omura et al. | |
| 9,704,626 | B2 | 7/2017 | Senda et al. | |
| 9,718,125 | B2 | 8/2017 | Bonnet et al. | |
| 2009/0047168 | A1 | 2/2009 | Murakami et al. | |
| 2011/0008537 | A1 | 1/2011 | Leveaux et al. | |
| 2013/0133783 | A1 | 5/2013 | Yamaguchi et al. | |
| 2013/0206283 | A1 | 8/2013 | Inoue et al. | |
| 2014/0065434 | A1 | 3/2014 | Van Steenberge et al. | |
| 2014/0234638 | A1 | 8/2014 | Takajo et al. | |
| 2014/0377573 | A1 | 12/2014 | Okubo et al. | |
| 2015/0187474 | A1 | 7/2015 | Takajo et al. | |
| 2016/0201154 | A1 | 7/2016 | Tomokiyo et al. | |
| 2016/0260531 | A1 | 9/2016 | Terashima et al. | |

FOREIGN PATENT DOCUMENTS

| | | | | |
|---|---|---|---|---|
| EP | 2145971 | A1 | 1/2010 | |
| GB | 1433432 | A | 4/1976 | |
| GB | 1514093 | A | 6/1978 | |
| WO | 8910426 | A1 | 11/1989 | |
| WO | WO-2005040442 | A1 * | 5/2005 | C22C 38/004 |
| WO | 2017043660 | A1 | 3/2017 | |

* cited by examiner

SYSTEMS AND METHODS FOR IN-LINE THERMAL FLATTENING AND ENAMELING OF STEEL SHEETS

CROSS-REFERENCE TO RELATED APPLICATIONS

This application claims priority to U.S. Provisional Application No. 62/595,295, filed Dec. 6, 2017, which is incorporated by reference in its entirety.

STATEMENT REGARDING FEDERALLY SPONSORED RESEARCH

N/A

BACKGROUND

Certain steel vitreous enameling procedures require highly stress-relieved and extremely flat starting material in order to achieve a final coated product that has minimal deviation from flatness. One such enameling procedure is a two-step, two-fire porcelain enameling process. It is difficult to determine prior to the enameling whether a starting material has sufficient stress relief and flatness to achieve the desired minimal deviation. Historically, cold rolled commercial steel that has been batch annealed has produced coated products with deviations from flatness that have exceeded needs. The solution to this problem has historically been to source continuously-annealed steel, which comes at a significantly increased cost.

Typical methods for correcting a lack of flatness in batch-annealed steel include temper rolling, roller leveling, tension leveling, and stretch leveling.

Temper rolling is primarily aimed at hardening annealed steel and removing yield-point elongation (kinking), but it has the secondary benefit of correcting flatness. Temper rolling is not to be confused with tempering, which is an unrelated heat treatment process in hot forging that has a similar name. Temper rolling involves a 0.5-1.5% reduction in thickness using a single or double series of rolls to provide a small amount of cold work to the steel.

Roller leveling is the most inexpensive way to correct imperfections in flatness on batch annealed material. Roller leveling is typically installed at the start of the processing line. (i.e., the coating line). Roller leveling involves about 0.25-0.5% cold reduction through a series of small rolls in a cassette.

Tension leveling is another common approach to shape correction. Tension leveling is essentially roller leveling with an added tension applied. Tension leveling is typically installed as a stand-alone operation or part of a continuous annealing line. Tension leveling can achieve up to 1.5% cold reduction with fewer rolls by the addition of strip tension to the roller leveler configuration.

Stretch levelling is the least common but most effective method of shape correction. It is typically installed as a stand-alone operation and used in specialty steel and alloys. It can achieve up to 3% cold reduction with no rolls by using extremely high strip tension.

These means of correcting flatness are mentioned as potential solutions to the problem of lack of flatness in batch-annealed steel that is required for certain enameling processes. However, when attempted, these means of correcting flatness are insufficient to overcome the lack of flatness in batch-annealed steel. Conventional flattening processes are unpredictable in their ability to convert batch-annealed steel into a state suitable for certain enameled steels.

Accordingly, a need exists for systems and methods that allow cold-rolled, batch-annealed steel to be received at a manufacturing facility and coated with a two-step, two-fire enameling process to provide a product that has sufficient flatness.

BRIEF SUMMARY

The present disclosure provides systems and methods for in-line thermal flattening and enameling of steel sheets.

In an aspect, the present disclosure provides a method of producing an enameled steel sheet having an enamel coating on both sides. The method includes: a) in-line thermal flattening a feed stock steel sheet, thereby producing a thermally-flattened steel sheet; and b) subsequent to step a), enamel coating the thermally-flattened steel sheet on both sides, thereby producing the enameled steel sheet having the enamel coating on both sides, wherein executing the enamel coating of step b) directly to the feed stock steel sheet without the in-line thermal flattening of step a) produces a comparison enameled steel sheet having the enamel coating on both side, the comparison enameled steel sheet having a maximum deviation from flat of 0.5 mm or greater when a pressure of 20 kg/m$^2$ is applied, the enameled steel sheet having a maximum deviation from flat of less than 0.5 mm when a pressure of 20 kg/m$^2$ is applied.

In another aspect, the present disclosure provides a system. The system includes a source zone, an in-line thermal flatting zone, a two-side enameling zone, and a product removal zone. The source zone is for receiving a source produce to be processed. The in-line thermal flattening zone is downstream of the source zone. The two-side enameling zone is downstream of the in-line thermal flattening zone. The product removal zone is for removing finished products from the system and is downstream of the two-side enameling zone.

DETAILED DESCRIPTION

Before the present invention is described in further detail, it is to be understood that the invention is not limited to the particular embodiments described. It is also to be understood that the terminology used herein is for the purpose of describing particular embodiments only, and is not intended to be limiting. The scope of the present invention will be limited only by the claims. As used herein, the singular forms "a", "an", and "the" include plural embodiments unless the context clearly dictates otherwise.

It should be apparent to those skilled in the art that many additional modifications beside those already described are possible without departing from the inventive concepts. In interpreting this disclosure, all terms should be interpreted in the broadest possible manner consistent with the context. Variations of the term "comprising", "including", or "having" should be interpreted as referring to elements, components, or steps in a non-exclusive manner, so the referenced elements, components, or steps may be combined with other elements, components, or steps that are not expressly referenced. Embodiments referenced as "comprising", "including", or "having" certain elements are also contemplated as "consisting essentially of" and "consisting of" those elements, unless the context clearly dictates otherwise. It should be appreciated that aspects of the disclosure that are described with respect to a system are applicable to the methods, and vice versa, unless the context explicitly dictates otherwise.

Numeric ranges disclosed herein are inclusive of their endpoints. For example, a numeric range of between 1 and 10 includes the values 1 and 10. When a series of numeric ranges are disclosed for a given value, the present disclosure expressly contemplates ranges including all combinations of the upper and lower bounds of those ranges. For example, a numeric range of between 1 and 10 or between 2 and 9 is intended to include the numeric ranges of between 1 and 9 and between 2 and 10.

The terms "upstream" and "downstream" refer to the direction of product movement through a system. If the product (i.e., steel sheet) interacts with a first component before interacting with a second component as it moves through a system, then the first component is upstream of the second component (and the second component is downstream of the first component).

Figure 1:
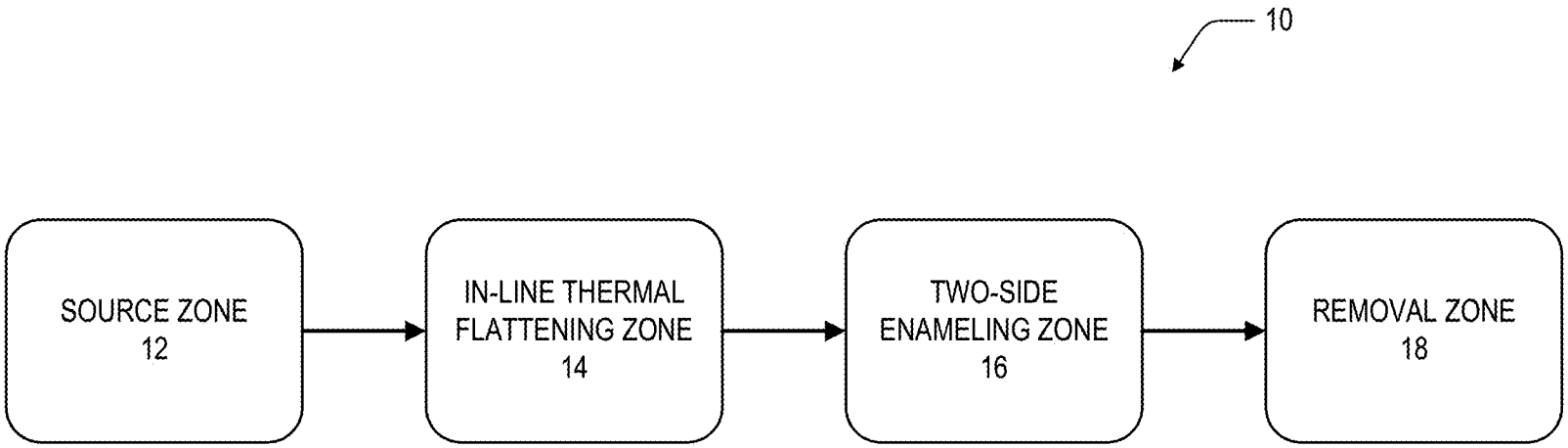
FIG. 1 is a schematic of a system, in accordance with aspects of the present disclosure.

Referring to FIG. 1, this disclosure provides a system 10 for in-line thermal flattening and two-side enameling of a steel sheet 20. The system 10 includes a source zone 12, an in-line thermal flattening zone 14, a two-side enameling zone 16, and a product removal zone 18.

The source zone 12 can include components known to those having ordinary skill in the art to be useful for loading steel sheet into the system 10. For example, an arm for receiving a roll of cold-rolled steel can be present in the source zone 12.

Figure 2:
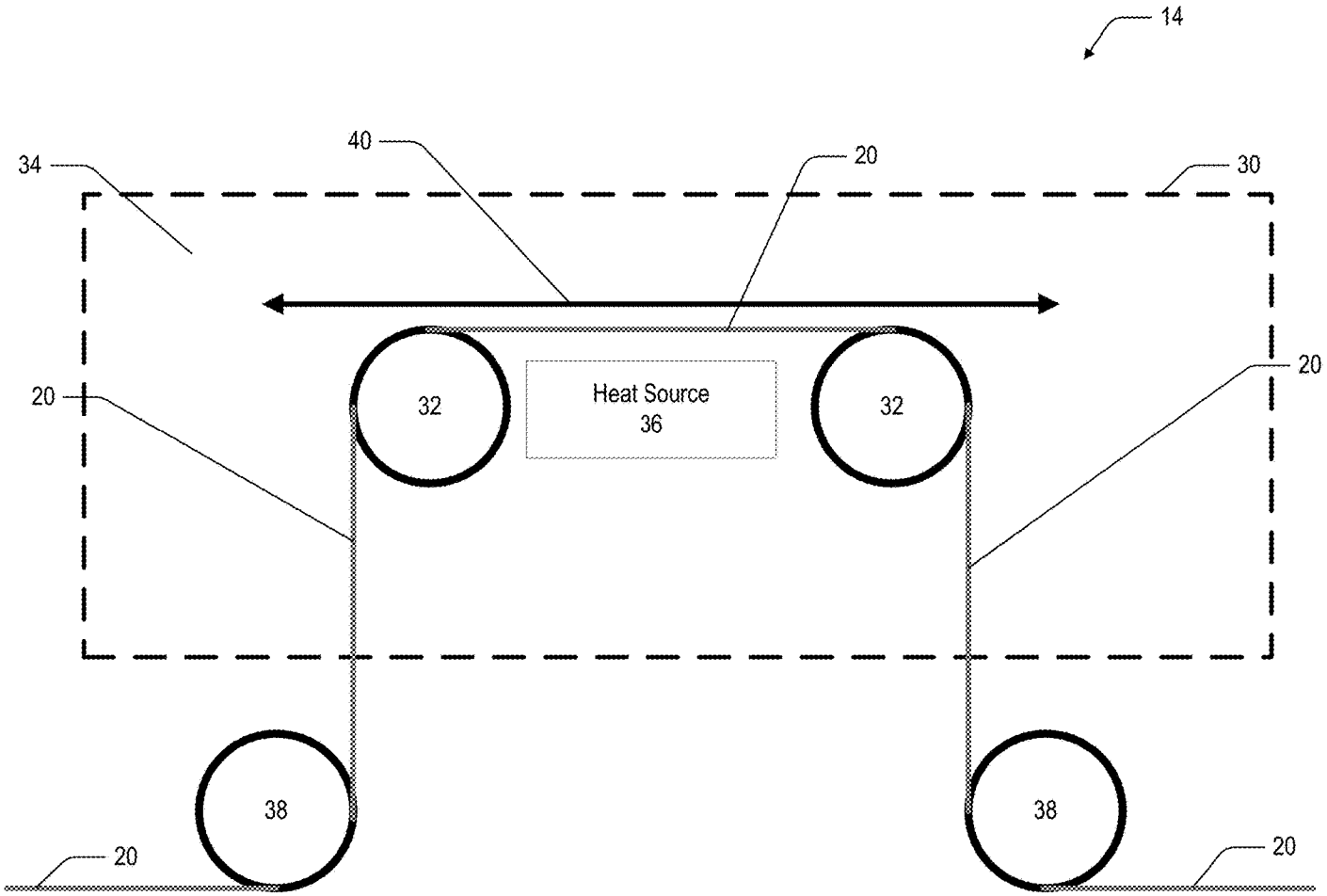
FIG. 2 is a schematic of an in-line thermal flattening zone of the system, in accordance with aspects of the present disclosure.

Referring to FIG. 2, one implementation of the in-line thermal flattening zone 14 is illustrated. The in-line thermal flattening zone 14 can include a furnace 30 having isolated atmosphere 34 and at least two tensioning rolls 32. The furnace 30 includes a heat source 36. The heat source 36 can be a radiant heat source, a convection heat transfer heat source, or a combination thereof. The heat source 36 can be electric or gas. The heat source 36 can be configured to, in the case where combustion is utilized (i.e., gas), isolate the products of combustion (i.e., $CO_2$, etc.) from the material being heated. The furnace 30 can be configured to operate at temperatures and with atmospheres described below with respect to method 100. The at least two tensioning rolls 32 can be configured to provide the tensions described below with respect to method 100. The direction of tension is illustrated by arrow 40. The in-line thermal flattening zone 14 can include other rollers 38 or various other positioning implements for aiding in alignment of the steel sheet.

Figure 3:
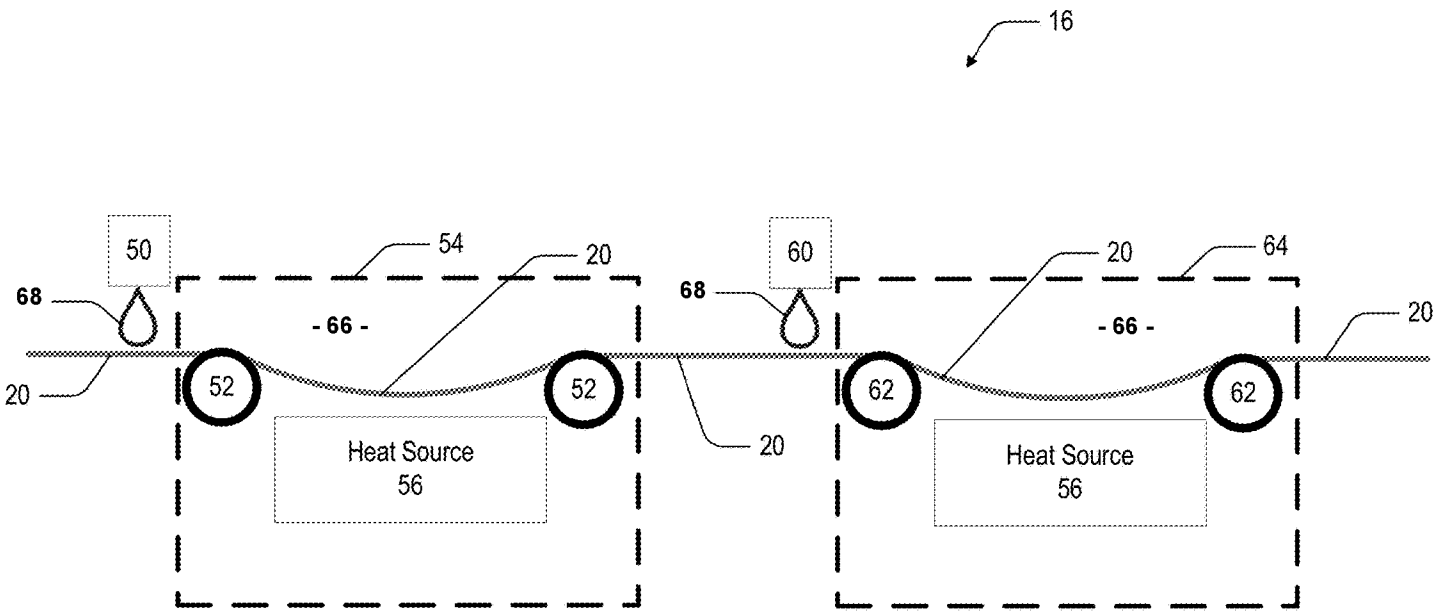
FIG. 3 is a schematic of a two-side enameling zone of the system, in accordance with aspects of the present disclosure.

Referring to FIG. 3, one implementation of the two-side enameling zone 14 is illustrated. The two-side enameling zone 16 is understood by those having ordinary skill in the porcelain enameling arts to encompass a variety of structural arrangements and the description that follows is merely one of the contemplated arrangements. The two-side enameling zone 16 can include a first slurry applicator 50, a first furnace catenary 52 configured to maintain tensions described below, a first furnace 54 having a first heat source 56 configured to apply the heat described below, a second slurry applicator 60, a second furnace catenary 62 configured to maintain tensions described below, and a second furnace 64 having a second heat source 56 configured to apply the heat described below. The first furnace 54 and the second furnace 64 are separate and distinct furnaces. The first furnace 54 and second furnaces 64 can have dust free atmospheres 66, which can be the same or different atmospheres. The first heat source 56 and/or the second heat source 56 can include radiant tubes. The radiant tubes can be natural gas fired. The first slurry applicator 50 and the second slurry applicator 60 apply slurry 68 to the steel sheet 20. The slurry 68 can be the same or different when applied to opposite sides of the steel sheet 20. The slurry 68 can be a porcelain enamel slip that is composed primarily of water and silicon dioxide.

The product removal zone 18 can include various cutting devices, rolling devices, stacking devices, and other means of manipulating the finished product to be suitable for transportation and sale.

Figure 4:
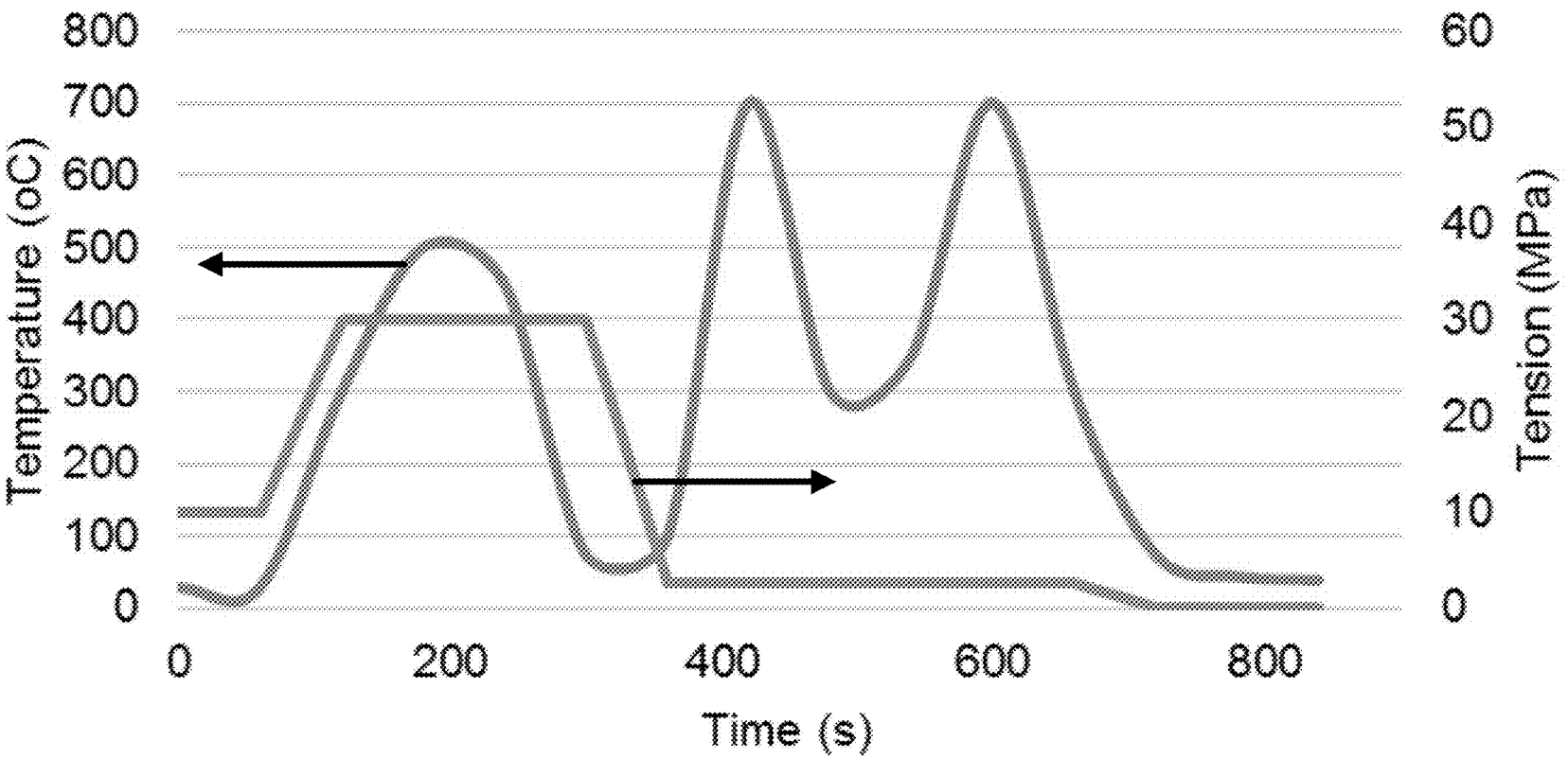
FIG. 4 is an exemplary temperature and tension profile for the systems and methods, in accordance with aspects of the present disclosure.

Referring to FIG. 4, one exemplary temperature and tension profile for the system 10 is shown. It should be appreciated that this temperature and tension profile is not intended to be limiting and other temperature and tension profiles are contemplated based on the principles outlined elsewhere herein.

Figure 5:
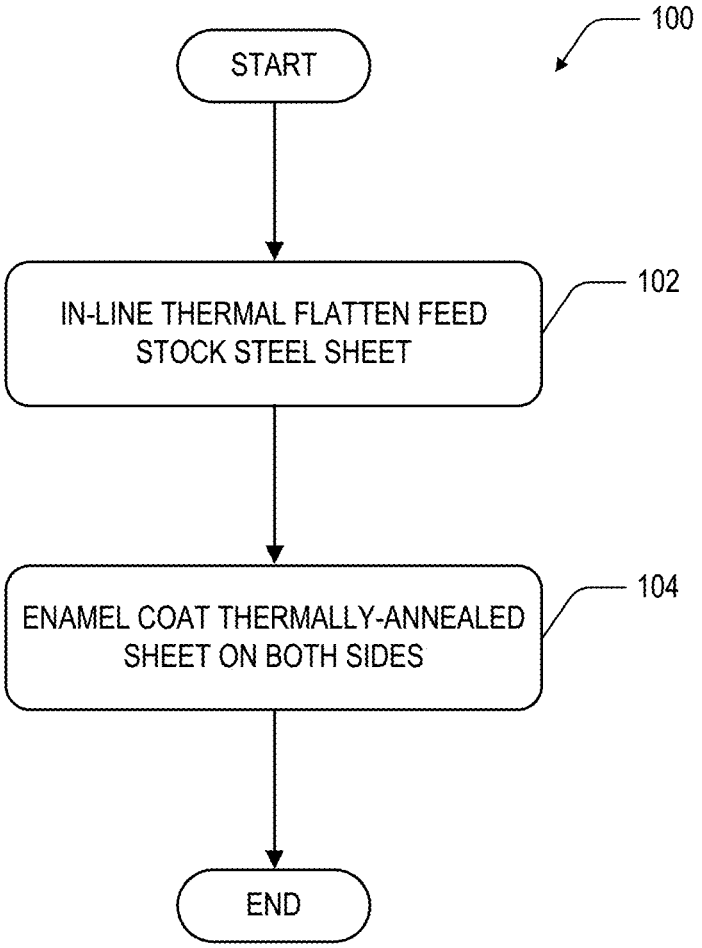
FIG. 5 is a flowchart of a method, in accordance with aspects of the present disclosure.

Referring to FIG. 5, this disclosure provides a method 100 of producing an enameled steel sheet having an enamel coating on both sides. At process block 102, the method 100 includes in-line thermal flattening a feed stock steel sheet. The in-line thermal flattening of process block 102 thereby produces a thermally-flattened steel sheet. At process block 104, the method 100 includes enamel coating the thermally-flattened steel sheet on both sides. The enamel coating of process block 104 thereby produces the enameled steel sheet having the enamel coating on both sides. The enamel coating of process block 104 is subsequent to the in-line thermal flattening of process block 102.

Executing the enamel coating of process block 104 directly to the feed stock steel sheet without the in-line thermal flattening of process block 102 produces a comparison enameled steel sheet. The comparison enameled steel sheet has properties that are inferior to the product of the method 100.

As one example, the comparison enameled steel sheet has a maximum deviation from flat of 0.5 mm or greater when a pressure of 20 $kg/m^2$ is applied. The enameled steel sheet produced by the method 100 has a maximum deviation from flat of less than 0.5 mm when a pressure of 20 $kg/m^2$ is applied. In some cases, the enameled steel sheet produced by the method 100 has a maximum deviation from flat of less than 0.5 mm when a pressure of 10 $kg/m^2$ is applied.

Maximum deviation can be measured by methods known to those having ordinary skill in the art. In one such method, the pressure is applied by setting a series of blocks having the proper weight to apply the desired force atop a sheet of interest that is itself resting on a flat surface. Once the blocks are placed, a point of greatest deviation from flat (or multiple points of greatest deviation if it is unclear which point is greater) are identified by human or automated visualization. The magnitude of that deviation is measured by distance measuring methods known to those having ordinary skill in the art (e.g., laser distance measurements, a ruler, a caliper, etc.).

The in-line thermal flattening of process block 102 includes heating the feed stock steel to a predetermined annealing temperature under a predetermined annealing tension. The predetermined annealing temperature can be between 300° C. and 700° C., including but not limited to, between 350° C. and 650° C. or between 400° C. and 600° C. The predetermined annealing tension can be between 20 MPa and 100 MPa, including but not limited to, between 25 MPa and 75 MPa, between 30 MPa and 50 MPa, or between 35 MPa and 40 MPa. The in-line thermal flattening of process block 102 can be done in a predetermined atmosphere. In some cases, the predetermined atmosphere can be air.

The enamel coating process of process block 104 can be a two-step, two-fire enameling process. The two-step, two-fire enameling process can include applying a ceramic slurry to both sides of a steel sheet and heating the sheet to predetermined enameling temperature while maintaining a substantially catenary position over a predetermined span distance at a predetermined lateral tension. This process is then repeated with application of the slurry to only one side of the steel sheet. The predetermined enameling temperature can be between 700° C. and 1000° C. The predetermined span distance can be between 1.0 m and 40 m, including but not limited to, between 2.5 m and 35 m, between 3.0 m and 30 m, between 4.0 and 25 m, or between 4.5 m and 20 m. In some cases, the predetermined span distance can be 4.5 m. The predetermined lateral tension can be between 2.0 MPa and 3.0 MPa, including 2.5 MPa. While one specific enamel coating process is described here in detail, it is contemplated that the method 100 can be suitable for use with other enamel coating processes known to those having ordinary skill in the porcelain enameling arts.

The feed stock steel sheet can be cold-rolled steel sheet. The cold-rolled steel sheet can be batch-annealed. The feed stock steel sheet can have a thickness of between 0.1 mm and 1.0 mm. The feed stock steel sheet can have a width of between 0.75 m and 2.0 m.

The resulting enamel coating can have a thickness of between 0.01 mm and 1.0 mm.

The feed stock steel sheet can be steel that meets the specifications of A242/A242M version 09a (Reapproved 2016) issued by ASTM International.

Process blocks 102 and 104 are performed in a single facility. Process block 102 and 104 can be performed in a single processing line.

The method 100 can further include cutting the enameled steel sheet into individual units. The cutting can be done by methods known to those having ordinary skill in the art.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments of the disclosures described herein can be embodied within a form that does not provide all of the features and benefits set forth herein, as some features can be used or practiced separately from others. The scope of certain disclosures disclosed herein is indicated by the appended claims rather than by the foregoing description. All changes which come within the meaning and range of equivalency of the claims are to be embraced within their scope.

I claim:

1. In a method comprising:

enamel coating a feed stock steel sheet, wherein the enameled coated feed stock steel sheet has a maximum deviation from flat of a comparing distance when a comparing pressure is applied to the enameled coated feed stock steel sheet;

an improvement to the method comprising:

thermal flattening the feed stock steel sheet by heating the feed stock steel to a temperature between 300° C. and 700° C., under a tension between 20 MPa and 100 MPa, and in an atmosphere of air, thereby producing a thermally-flattened steel sheet prior to enamel coating, wherein the feed stock steel sheet has a thickness of between 0.1 mm to 1.0 mm and a width of between 0.75 m to 2.0 m; and enamel coating the thermally-flattened steel sheet on both sides, forming an enameled steel sheet having an enamel coating with a thickness of between 0.01 mm and 1.0 mm on both sides;

wherein the enamel coated thermally-flattened steel sheet has a maximum deviation from flat of less than the comparing distance when the comparing pressure is applied.

2. The method of claim 1, wherein the thermal flattening comprises in-line thermal flattening.

3. The method of claim 1, wherein the enamel coating is a two-step, two-fire enameling process.

4. The method of claim 3, wherein the two-step, two-fire enameling process comprises:

applying a first ceramic slurry to a first side of the thermally-flattened steel sheet, forming a first slurried steel sheet;

heating the first slurried steel sheet to a temperature of between 700° C. and 1000° C. while maintaining the first slurried steel sheet in a catenary position with the first side or a second side opposite the first side pointing upward over a span of between 1.0 m and 40 m and a lateral tension of between 2.0 MPa and 3.0 MPa, forming a first coated steel sheet;

applying a second ceramic slurry to the second side of the first coated steel sheet, forming a second slurried steel sheet; and heating the second slurried steel sheet to a temperature of between 700° C. and 1000° C. while maintaining the second slurried steel sheet in a catenary position with the first side or the second side pointing upward over a span of between 1.0 m and 40 m and a lateral tension of between 2.0 MPa and 3.0 MIPa, forming the enamel coated thermally-flattened steel sheet.

5. The method of claim 4, wherein applying the first ceramic slurry comprises applying the first ceramic slurry to the first side of the thermally-flattened steel sheet and to the second side of the thermally-flattened steel sheet, forming the first slurried steel sheet.

6. The method of claim 1, wherein the enamel coated thermally-flattened steel sheet has a maximum deviation from flat of less than 0.5 mm when a pressure of 10 $kg/m^2$ is applied.

7. The method of claim 1, wherein the thermal flattening and enamel coating are performed in a single facility.

8. The method of claim 1, wherein the thermal flattening and enamel coating are performed in a single processing line.

9. The method of 1 further comprising cutting the enamel coated thermally-flattened steel sheet into individual units.

10. The method of claim 1, wherein:

the thermal flattening occurs in an in-line thermal flattening zone downstream of a source zone;

the enamel coating occurs in a two-side enameling zone downstream of the in-line thermal flattening zone; and the enamel coated thermally-flattened steel sheet is removed in a product removal zone downstream of the two-side enameling zone.

11. The method of claim 10, wherein the in-line thermal flattening zone includes a furnace and at least two tensioning rolls.

12. The method of claim 11 further comprising establishing and maintaining the tension of between 20 MPa and 100 MPa with the at least two tensioning rolls for the feed stock steel sheet passing through the in-line thermal flattening zone.

13. The method of claim 11, wherein the furnace includes a thermal flattening heat source.

14. The method of claim 13 further comprising establishing and maintaining the temperature of between 300° C. and 700° C. with the thermal flattening heat source for the feed stock steel sheets passing through the in-line thermal flattening zone.

15. The method of claim 10, wherein the two-side enameling zone comprises:

a first slurry applicator;

a first furnace catenary;

a second slurry applicator; and a second furnace catenary;

wherein the first slurry applicator is upstream of the first furnace catenary;

wherein the first furnace catenary is upstream of the second slurry applicator; and wherein the second slurry applicator is upstream of the second furnace catenary.

16. The method of claim 15, wherein the two-side enameling zone further comprises:

a first heat source; and a second heat source;

wherein the first heat source is configured to heat material within the first furnace catenary to a first predetermined temperature; and wherein the second heat source is configured to heat material within the second furnace catenary to a second predetermined temperature.

17. The method of claim 16, wherein either or both of the first predetermined temperature and the second predetermined temperature is between 700° C. and 1000° C.

18. The method of claim 16, wherein either or both of the first heat source and the second heat source comprise one or more radiant tubes.

19. The method of claim 18 further comprising natural gas firing the one or more radiant tubes.

20. The method of claim 15, wherein the first furnace catenary is housed in a first furnace; and wherein the second furnace catenary is housed in a second furnace.

21. The method of claim 20 further comprising:

providing a first isolated atmosphere by the first furnace; and providing a second isolated atmosphere by the second furnace.

22. The method of claim 15, wherein either or both of the first furnace catenary and the second furnace catenary is configured to have a span of between 1.0 m and 40 m.

23. The method of claim 15 further comprising maintaining a lateral tension of between 2.0 MPa and 3.0 MPa by either or both of the first furnace catenary and the second furnace catenary.

24. The method of claim 1, wherein the feed stock steel sheet is a cold-rolled steel sheet.

25. The method of claim 24, wherein the cold-rolled steel sheet is batch-annealed.

26. A method comprising:

thermal flattening a feed stock steel sheet; and enamel coating with a two-step, two-fire enameling process the thermally-flattened steel sheet, forming an enameled steel sheet having an enamel coating;

wherein the two-step, two-fire enameling process comprises:

applying a first ceramic slurry to at least one side of the thermally-flattened steel sheet having a first side and a second side opposite the first side, forming a first slurried steel sheet having either:

one surface applied with slurry and the other surface without slurry; or both surfaces applied with slurry;

heating the first slurried steel sheet to a temperature between 700° C. and 1000° C. while maintaining the first slurried steel sheet in a catenary position with the first side or the second side pointing upward over a span of between 1.0 m and 40 m and a lateral tension of between 2.0 MPa and 3.0 MPa, forming a first coated steel sheet;

applying a second ceramic slurry to one side of the first coated steel sheet, the one side is either:

the surface without applied first ceramic slurry; or if both surfaces were applied with first ceramic slurry, either one of the surfaces; and heating the second slurried steel sheet to a temperature between 700° C. and 1000° C. while maintaining the second slurried steel sheet in a catenary position with the first side or the second side pointing upward over a span of between 1.0 m and 40 m and a lateral tension of between 2.0 MPa and 3.0 MPa, forming the enameled steel sheet having an enamel coating on both sides.

27. The method of claim 26, wherein the enameled steel sheet has a maximum deviation from flat of less than 0.5 mm when a pressure of 10 kg/m$^2$ is applied.

28. The method of claim 26, wherein the thermal flattening comprises heating the feed stock steel to a predetermined temperature under a predetermined tension, and in a predetermined atmosphere; and at least one of the following:

the predetermined atmosphere is air;

the predetermined temperature is between 300° C. and 700° C.; and the predetermined tension is between 20 MPa and 100 MPa.

29. The method of claim 26, wherein the feed stock steel sheet is a cold-rolled steel sheet.

30. The method of claim 29, wherein the cold-rolled steel sheet is batch-annealed.

31. The method of claim 26 further comprising at least one of the following:

the feed stock steel sheet has a thickness of between 0.1 mm to 1.0 mm;

the feed stock steel sheet has a width of between 0.75 m to 2.0 m; and the enamel coating has a thickness of between 0.01 mm and 1.0 mm.

32. The method of claim 26, wherein the thermal flattening and the enamel coating are performed in a single facility.

33. The method of claim 26, wherein the thermal flattening and the enamel coating are performed in a single processing line.

34. The method of claim 26 further comprising cutting the enameled steel sheet into individual units.

35. The method of claim 26, wherein the thermal flattening comprises in-line thermal flattening.

36. The method of claim 26, wherein:

the thermal flattening occurs in an in-line thermal flattening zone downstream of a source zone;

the enamel coating occurs in a two-side enameling zone downstream of the in-line thermal flattening zone; and the enamel coated thermally-flattened steel sheet is removed in a product removal zone downstream of the two-side enameling zone.

37. The method of claim 36, wherein the in-line thermal flattening zone includes a furnace and at least two tensioning rolls.

38. The method of claim 36, wherein the two-side enameling zone comprises:

a first slurry applicator;

a first furnace catenary;

a second slurry applicator; and a second furnace catenary;

wherein the first slurry applicator is upstream of the first furnace catenary;

wherein the first furnace catenary is upstream of the second slurry applicator; and wherein the second slurry applicator is upstream of the second furnace catenary.

39. The method of claim 37, wherein the thermal flattening comprises thermal flattening the feed stock steel sheet by heating the feed stock steel to a temperature between 300° C. and 700° C., under a tension between 20 MPa and 100 MPa, and in an atmosphere of air; and wherein the tension of between 20 MPa and 100 MPa is established and maintained with the at least two tensioning rolls for the feed stock steel sheet passing through the in-line thermal flattening zone.

40. The method of claim 37, wherein the furnace includes a thermal flattening heat source.

41. The method of claim 38, wherein the two-side enameling zone further comprises:

a first heat source; and a second heat source;

wherein the first heat source is configured to heat the first slurried steel sheet within the first furnace catenary to the temperature between 700° C. and 1000° C.; and wherein the second heat source is configured to heat the second slurried steel sheet within the second furnace catenary to the temperature between 700° C. and 1000° C.

42. The method of claim 41, wherein either or both of the first heat source and the second heat source comprise one or more radiant tubes.

43. The method of claim 42 further comprising natural gas firing the one or more radiant tubes.

44. The method of claim 38, wherein the first furnace catenary is housed in a first furnace; and wherein the second furnace catenary is housed in a second furnace.

45. The method of claim 44 further comprising:

providing a first isolated atmosphere by the first furnace; and providing a second isolated atmosphere by the second furnace.

* * * * *